United States Patent [19]

Van Zyl et al.

[11] Patent Number: 4,600,105

[45] Date of Patent: Jul. 15, 1986

[54] METHOD AND APPARATUS FOR SORTING OBJECTS OF ORE BY MONITORING REFLECTED RADIATION

[75] Inventors: Ian D. Van Zyl, Bordeaux; Peter Wolf, Edenvale, both of South Africa

[73] Assignee: Sphere Investments Limited, Nassau, The Bahamas

[21] Appl. No.: 592,841

[22] Filed: Mar. 23, 1984

[30] Foreign Application Priority Data

Mar. 23, 1983 [ZA] South Africa ..... 83/2020

[51] Int. Cl.[4] ..... B07C 5/342

[52] U.S. Cl. ..... 209/587; 209/576; 209/579; 209/585; 356/446; 356/448

[58] Field of Search ..... 209/576–579, 209/585, 587; 356/446, 448; 364/498

[56] References Cited

U.S. PATENT DOCUMENTS

| | | | |
|---|---|---|---|
| 3,747,755 | 7/1973 | Senturia et al. | 209/930 X |
| 3,789,983 | 2/1974 | Senesky | 209/587 |
| 4,122,952 | 10/1978 | Richards | 209/579 |
| 4,226,541 | 10/1980 | Tisue | 356/446 |

FOREIGN PATENT DOCUMENTS

| | | | |
|---|---|---|---|
| 3212190 | 10/1983 | Fed. Rep. of Germany | 209/579 |
| 690230 | 12/1968 | South Africa . | |
| 0703694 | 2/1954 | United Kingdom | 209/587 |
| 0939085 | 6/1982 | U.S.S.R. | 209/587 |

*Primary Examiner*—Robert B. Reeves
*Assistant Examiner*—Edward M. Wacyra
*Attorney, Agent, or Firm*—Cushman, Darby & Cushman

[57] ABSTRACT

A method of ore sorting includes distinguishing ore objects or ore containing objects by the light reflected from a laser beam arranged to scan across each of the objects to be sorted. Where the surface of the object is transmitting to the light a halo is produced by certain objects caused by internal scattered reflections of the light. By monitoring the occurrence or degree of occurrences of halos clean distinction of respective objects can be made. In a particular application, the identification of the presence of quartz pebbles in rock specimens can be used for detecting and sorting gold containing objects.

4 Claims, 23 Drawing Figures

DARK BRUISED WASTE
LIGHT OUARTZ WASTE
WASTE
REEF
DARK REEF
LIGHT REEF
LIGHT
DARK
HIGH
LOW
22
24
26
28

LIGHT WASTE (NON QUARTZ)

DARK WASTE (NON BRUISED)

METHOD AND APPARATUS FOR SORTING OBJECTS OF ORE BY MONITORING REFLECTED RADIATION

BACKGROUND TO THE INVENTION

This invention relates to ore sorting, and finds particular although not exclusive application in the sorting of gold-bearing reef from waste material. In manual sorting of gold-bearing ore, a distinction can be made between reef and waste, because the reef has a pebbly, non-homogeneous appearance, whereas the waste is generally homogeneous and non-pebbly in appearance. The pebbly appearance of reef arises because of the presence of quartz pebbles in the host matrix.

Conventional photometric sorting systems have no problem in distinguishing light areas from dark areas of a specimen rock. Such systems are therefore able to sort dark rocks from light rocks. Gold-bearing reef can be either dark or light in appearance, as can the waste.

If darkness is used as the sorting criterion for separating dark reef, dark waste reports together with the dark reef in the accept fraction. The accept fraction is therefore diluted with dark waste. Similarly, light waste and light reef report with the reject fraction.

Where a specimen is scanned and its acceptability determined in accordance with the presence or otherwise of light areas in a darker matrix (intended to sort specimens which have quartz pebbles in the matrix), the problem exists that dark waste may be bruised (e.g. as a result of collisions etc.), with the result that the apparatus detects the lighter bruised areas in the same way as it detects lighter areas in a dark reef specimen.

A system which could additionally distinguish rock specimens from one another according to whether they are pebbly or not, for example, that is in the case of good reef sorting, according to whether pebbles of quartz are present in the matrix or not, would therefore be most desirable, approximating perhaps more closely in its decisions to human decisions based on the pebbly nature or otherwise of a specimen which is sorted manually.

In the specification "ore objects" or "objects of ore" are to be regarded as objects possessing a certain physical characteristic, whereas "objects" or "waste" may possess the same physical characteristic but to a lesser degree, or may not possess the physical characteristic at all. Thus, where mention is made of sorting "ore objects" it is intended that sorting is carried out to distinguich objects possessing a certain physical characteristic from objects which either do not possess the physical characteristic or possess it to a lesser degree the physical characteristic which is to be determined in order to distinguish between objects of ore and other objects relating to the incoroporation, in objects of ore, of one or more translucent inclusions capable of re-emitting internal reflections.

SUMMARY OF THE INVENTION

According to an aspect of the invention there is provided a method of sorting objects of ore from other objects including scanning each object with a beam of light, detecting light reflected from the object, distinguishing between light which is reflected at least predominently from the surface of the object from light which has been scattered by being internally reflected in the object, and sorting the objects in accordance with the degree to which internal reflection has taken place.

According to another aspect of the invention there is provided a method of sorting objects of ore from other objects, which includes scanning each object with a beam of light, monitoring light reflected by the object to detect the occurence of a corona effect, and sorting the objects in dependence upon the occurence of the corona effect.

According to a further aspect of the invention there is provided a method for sorting objects of ore from other objects, the method including the steps of scanning each object with a beam of light, monitoring radiation reflected from the object and generating signals derived therefrom indicative of whether the surface of the object is opaque to the radiation at the incidence of the beam or not, and sorting the objects in accordance with whether their surfaces are at least partially transmitting to the radiation.

According to yet further aspects of the invention there is provided apparatus for carrying out the above methods.

Embodiments of the invention can be carried out in combination with other ore sorting techniques, in which case the embodiments provide confirmatory or distinguishing indications of the presence of ore objects or waste. For example as described later, an embodiment of the invention is used in combination with an optical scanning arrangement which determines whether the surface of the object is light or dark to provide a first indication of the presence of ore and a method and apparatus of the invention enables further decisions to be made to distinguish objects containing ore in combination with such first indications.

In one application of the invention radiation is provided from a laser source and is used to detect the presence of quartz pebbles in the surface of objects. If the quartz is transmitting to the radiation, light enters the quartz pebble and is internally reflected and scattered within the quartz pebble. This produces a "corona effect" of light reflected from the object which is readily detectable and provides a clear indication of the presence of quartz pebbles at the surface of the object as the laser beam scans over the surface.

A system of fibre-optics light guides coupled to a light sensitive detector can be used for detecting the light reflected from selected areas of the object as a laser beam scans over the object and for producing signals representative of the intensity of the light detected.

BRIEF DESCRIPTION OF THE DRAWINGS

A embodiment of the invention will now be described by way of example with reference to the accompanying drawings in which.

DESCRIPTION OF THE PREFERRED EMBODIMENT

Figure 1:
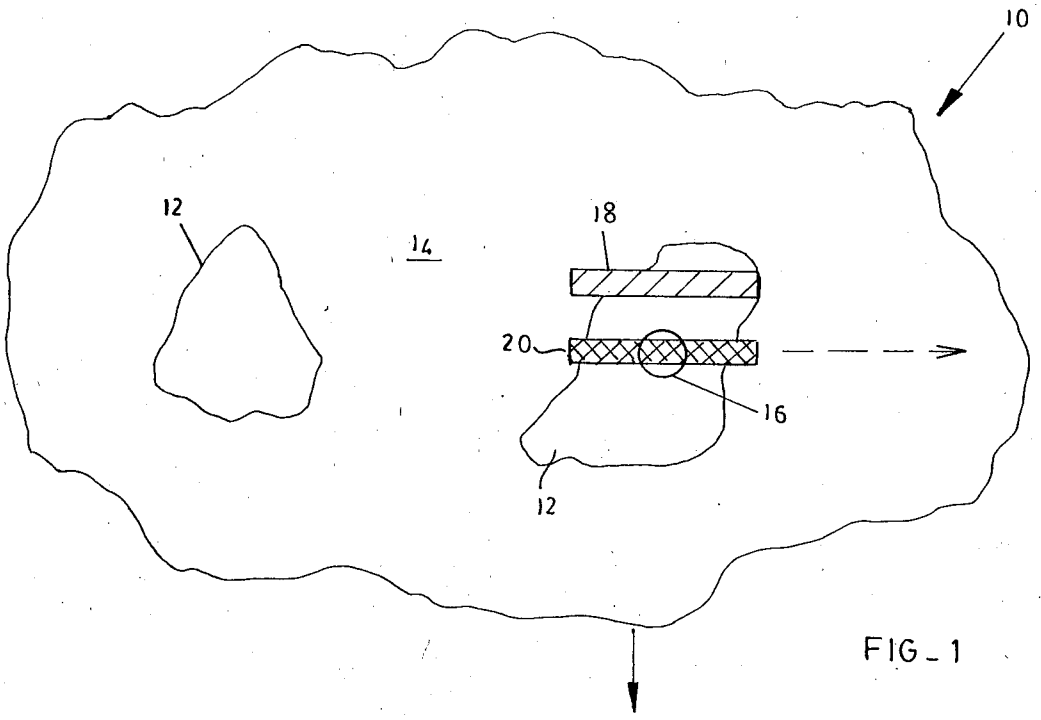
FIG. 1 shows part of a specimen of gold bearing reef and illustrates the incidence of a laser beam on the specimen and areas of light detection.

Referring to FIG. 1, there is shown a part of a gold bearing reef object 10, which incorporates a number of quartz pebbles 12 embedded in a host matrix 14. In the implementation of the method of the invention, a narrow laser beam is directed onto the rock specimen and caused to scan across the specimen. One way in which this can be done is by means of a rotating mirror drum of the type described in South African Pat. No. 69/0230.

The area of incidence of the laser beam at a particular stage in the scan is depicted in FIG. 1 by the numeral 16. Typically, the laser beam has a diameter of about 2 mm. The light reflected from the area of incidence, i.e. from the area 16, as the laser beam scans across the width of the rock is detected by a central fibre optic light guide, having an effective window depicted by an area 20, coupled to a photomultiplier (P.M.) tube which generates a signal representative of the light detected.

When the laser beam impinges on the quartz pebbles in the rock, as the quartz is transmitting to the laser beam, the whole pebble appears to be illuminated internally as a result of the optical properties of quartz.

Coupled to a second P.M. tube, is a second fibre optic light guide bundle arranged to detect light from an area 18 displaced from and adjacent to the actual area of incidence of the laser beam on the rock. Thus, when the area of incidence 16 of the laser beam is at the position shown in FIG. 1, light re-emitted from the area 18 is detected via this fibre optic light guide.

Figure 22:
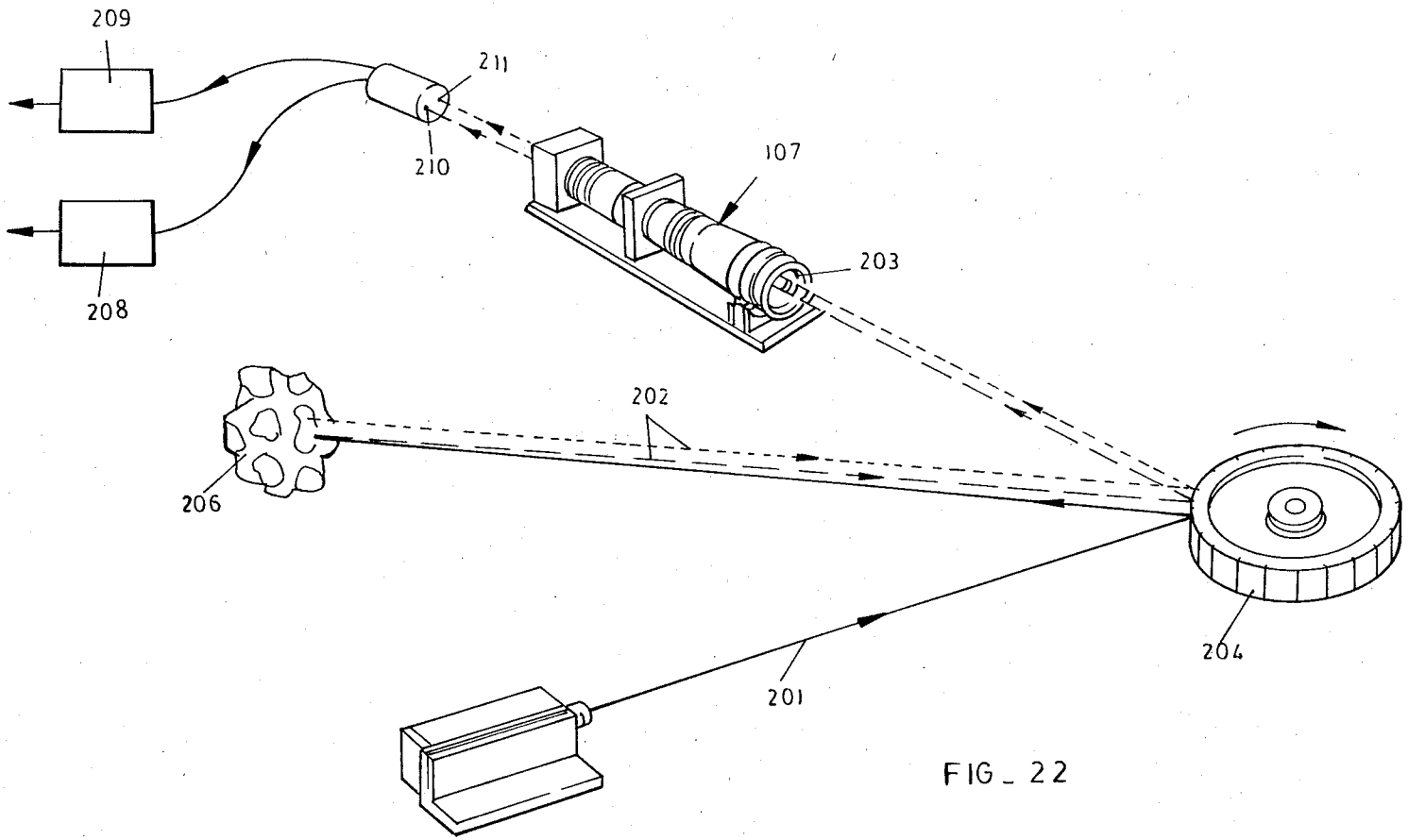
FIG. 22 shows schematically, a scanning arrangement (laser, mirror drum, fibre optic light guides, photomultipliers) as used in the preferred embodiment.

Each fibre optic bundle serves continuously to detect the light from the area 18 and 20 respectively as the beam scans across the specimen 10. A rotating mirror drum of the type described in South African Pat. No. 69/0230 could be modified for this purpose. Such a modified system is shown in FIG. 22.

Figures 2, 3, 4, 5, 6, 7, 8, 9, 10, 11, 12, 13:
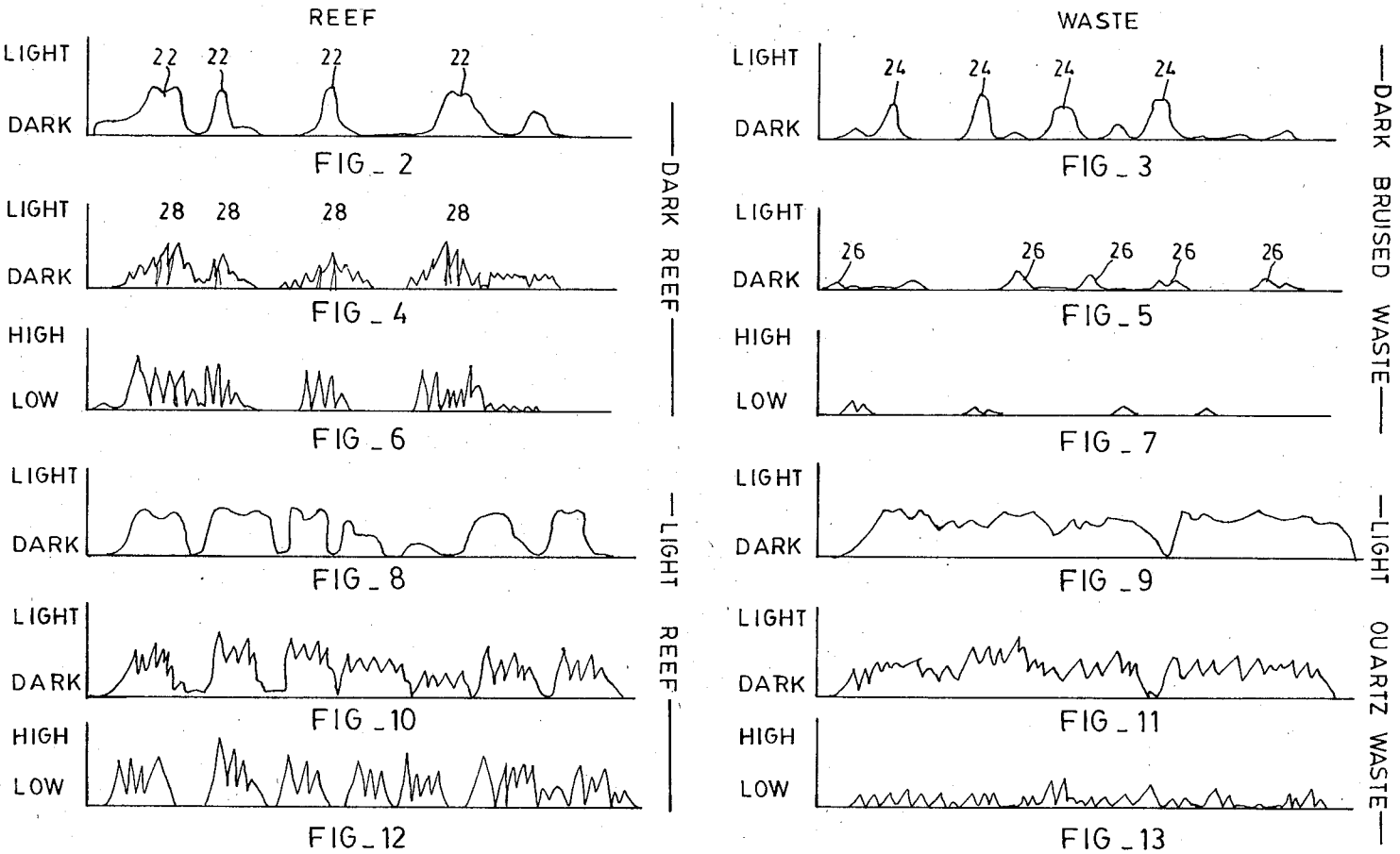
FIGS. 2 and 3 show diagrammatically typical expected light detection profiles when carrying out the invention across a specimen of dark reef and dark "bruised" waste respectively, the light in this case being that reflected from the area of incidence of the laser beam.
FIGS. 4 and 5 show diagrammatically typical light detection profiles across the dark reef and the dark waste specimens respectively, light in this case being detected from an area adjacent to the area of incidence of the laser beam.
FIGS. 6 and 7 show diagrammatically the first derivative of light detection profiles, FIGS. 4 and 5 respectively, such signals, being generated by differentiation.
FIGS. 8 and 9 show diagrammatically typical expected light detection profiles for specimens of light reef and light waste respectively, the light being detected in this case from the area of incidence of the laser beam.
FIGS. 10 and 11 show diagrammatically typical expected light detection profiles for the reef and waste specimens of FIGS. 8 and 9, the light being detected from an area adjacent to the area of incidence of the laser beam.
FIGS. 12 and 13 show diagrammatically typical first derivatives of FIGS. 10 and 11, such derivatives being generated by differentiating the appropriate light detection profiles.

Typical light detection profiles for dark reef and dark waste across the width of the specimen are shown in FIGS. 2 and 3, the light in this case being that emitted by way of reflection from the area of actual incidence of the laser beam. The profile for dark reef shows that the specimen is predominantly dark, but with lighter peaks 22 resulting from the incidence of the laser beam on the lighter quartz pebbles 12. Similarly, the dark waste has a profile which indicates predominantly dark material, but with lighter peaks 24 resulting from the reflection of light from the lighter "bruised" zones of the specimen. There is little to distinguish the general form of the two profiles, so that, as in the prior art sorters, a reliable sort is not possible on this basis alone, because an undesirably high proportion of dark waste would be caused to report to the reef fraction.

FIGS. 4 and 5 show the profiles expected from the area 18 (FIG. 1). The magnitude of the peaks 26 detected in this area in a specimen of dark, 'bruised' waste is very much less (FIG. 5) than in the case of FIG. 3, since the laser beam is not incident here. There is, however, a marked difference between the FIG. 5 profile and the FIG. 4 profile. In the FIG. 4 profile, the internal illumination of the quartz pebble gives rise to substantial peaks 28.

FIG. 6 represents the first derivative of FIG. 4 which relates to the rate of change of the light detection profile as shown in FIG. 4. Similarly, FIG. 7 shows the differentiated light detection profile of FIG. 5.

As explained above, dark reef can clearly be distinguished from dark, 'bruised' waste by utilising the marked difference of light reflection profiles in FIG. 4 and FIG. 5, so that in this case, there is no need to further consult the derivatives of these profiles.

The P.M. tubes are arranged to generate signals representative of the light reflected from areas 18 and 20, the strength of the signal at a given stage of the scan being indicative of the intensity of the light.

The P.M. tube signal relating to area 18 is further differentiated with the differential signal being indicative of the rate of change of the P.M. tube signal.

Typical expected results for the signal strength and the magnitude of change of the signal strength for dark reef, 'bruised' waste and dark, 'unbruised' waste can be summarised as follows:

Dark Reef

First signals derived from the detection of light from the area 20 (hereinafter referred to as "I" signal) are generally weak signals, with well-defined peaks resulting from reflections from quartz pebbles and lighter areas (see FIG. 2).

Second signals derived from the detection of light from the area 18 (hereinafter referred to as "O" signal): are generally weak signals with well-defined peaks resulting from illumination of the quartz pebbles. (See FIG. 4).

Third signals ls derived from differentiating the "O" signal (hereinafter referred to as "dO" signal), are generally low but showing many high peaks coinciding with peaks of the "O" signal resulting from rapid changes of the O signal. (See FIG. 6).

Dark Waste with 'Bruising'

"I" signals are produced which are generally weak with well-defined peaks resulting from reflection from the bruises. (See FIG. 3).

"O" signals are very weak to non-existent (FIG. 5).

"dO" signals have very small peaks or non-existent (FIG. 7).

Dark Waste without 'Bruising'

Figure 14:
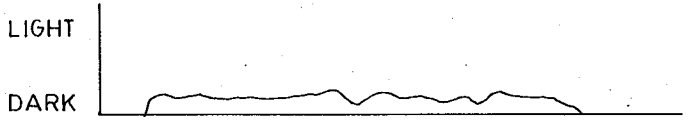

"I" signals are generally weak with little variation. (FIG. 14)

Figure 16:
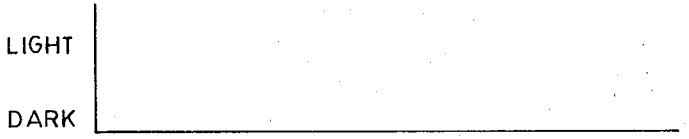

"O" signals are extremely weak or non-existent. (FIG. 16)

Figure 18:
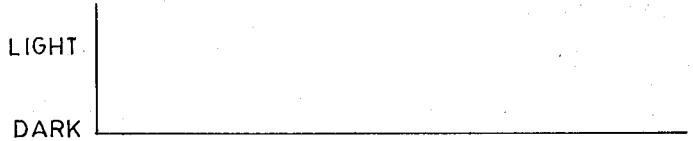

"dO" signals are few extremely small peaks or are non-existent. (FIG. 18)

FIGS. 8, 10 and 12 show typical profiles expected for light reef particles and FIGS. 9, 11 and 13 corresponding profiles for light (quartz based) waste particles. Typical expected results for the "I", "O" and "DO" signals can be summarised as follows:

Light Reef

"I" signals are generally strong with moderate fluctuations. (See FIG. 8).

"O" signals are generally weak signals with well defined peaks (See FIG. 10).

"dO" signals have many high peaks conciding with peaks of the "O" signal.

Light (Quartz) Waste

"I" signals are generally strong with little variation. (See FIG. 9).

"O" signals are generally strong with little variation. (See FIG. 11).

"dO" signals have few high peaks—indicating little change in "O" signal (See FIG. 13).

Light Waste (non quartz)

Figure 15:
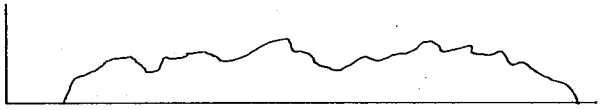
FIGS. 14 and 15 show diagrammatically typical expected light detection profiles for specimens of dark waste and light waste respectively, the light detected from the area of incidence of the laser beam.

"I" signals are generally strong with little variation. (FIG. 15)

Figure 17:
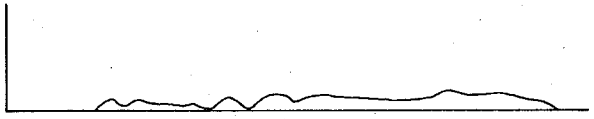
FIGS. 16 and 17 show the light of the specimens of FIGS. 14 and 15 detected from an area adjacent to the area of incidence of the laser beam.

"O" signals are very weak with little variation. (FIG. 17)

Figure 19:
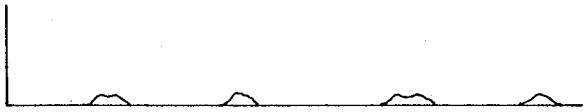
FIGS. 18 and 19 show diagrammatically first derivative in FIGS. 16 and 17.

"dO" signals have very few small peaks. (FIG. 19)

From the above can be seen that Reef (light or dark) and light quartz type waste both show strong "O" signals but that this type of waste material can be clearly distinguished from reef by the difference in the respective "dO" signals.

A suitable logical analysis of the "I", "O" and "dO" signals can now be carried out and a separation between reef and waste particles performed on the basis of the results of such analysis.

Figures 20, 21:
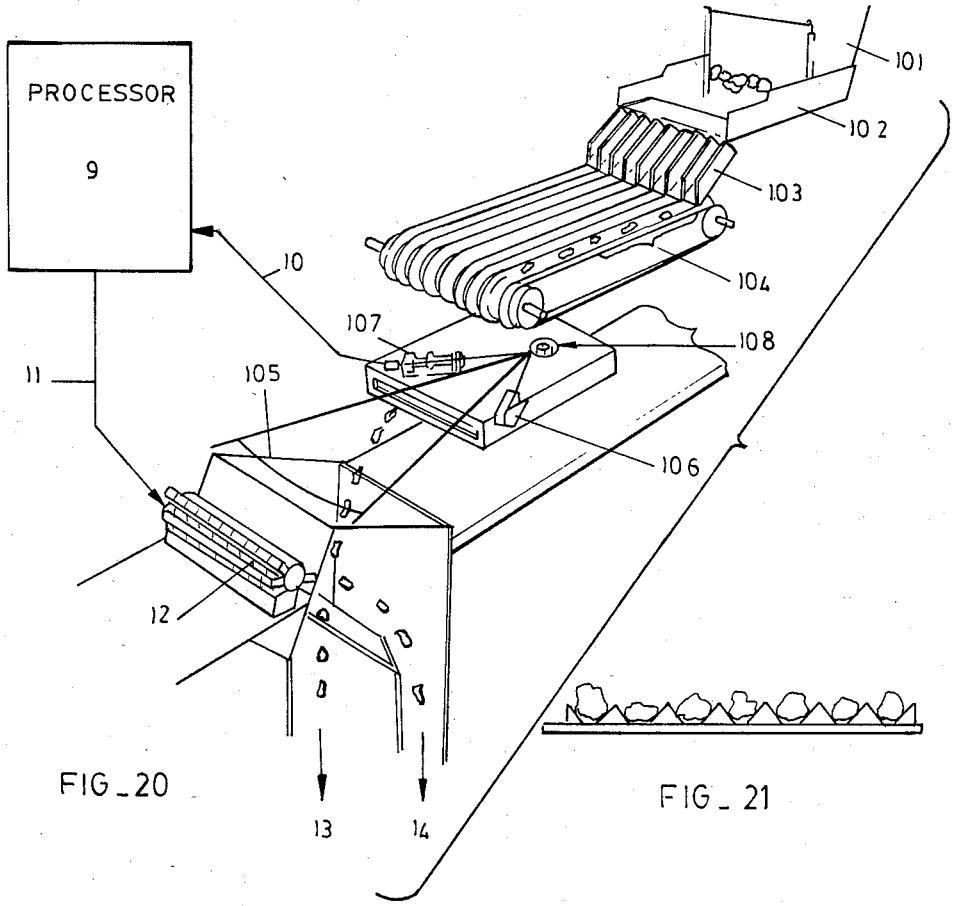
FIG. 20 shows schematically, an ore sorting machine designed to separate ore particles from waste particles by utilising the method here described.
FIG. 21 shows schematically, a cross-section of the feed conveyor belt of an ore sorting machine as shown in FIG. 14.

In FIG. 20, ore particles are drawn from an ore bin 101 by means of a vibrating feeder 102. The vibrating feeder spreads the particles, via feed chutes 103, evenly over all channels of a feedbelt 104.

The ore particles settle down into the V-sectioned channel arrangement of the feedbelt 104, ore particles follow a trajectory which intersects an optical scan line 105. A HeNe laser 106 and an optical detection system 107 are pointed at a facetted mirror drum 108 which rotates at approximately 100 r.p.s.

In FIG. 22, a laser beam 201 and an optical viewing line 202 scan repeatedly across the ore particle trajectory lines in such a manner that the optical detection system 107 views the area which is struck by the laser beam (Described in South African Pat. No. 69/0230).

Via a mirrored drum 204 and a lens system 203 images from rock particles 206 are imaged onto a fibre optic head 107 where the light received is passed to two photomultipliers 208 and 209. The arrangement of windows 210 and 211 of the fibre optic head is such that the image of the area 20 and 18 are projected on windows 210 and 211 respectively. From each of the two 'windows' the 'light' is guided to a respective separate photomultiplier tube, from the window 210 to P.M. tube 208 and from window 11 to P.M. tube 209.

Each P.M. tube converts the optical signal it receives into electric signals 214 and 215.

One of the signals 214 (from now on referred to as "I")is proportional to the amount of 'light intensity' reflected from the rock surface area 20. The other signal 215 (from now on referred to as "O"), is proportional to 'light intensity' re-emitted from the area 18 of the rock particle resulting from the "corona effect".

Figure 23:
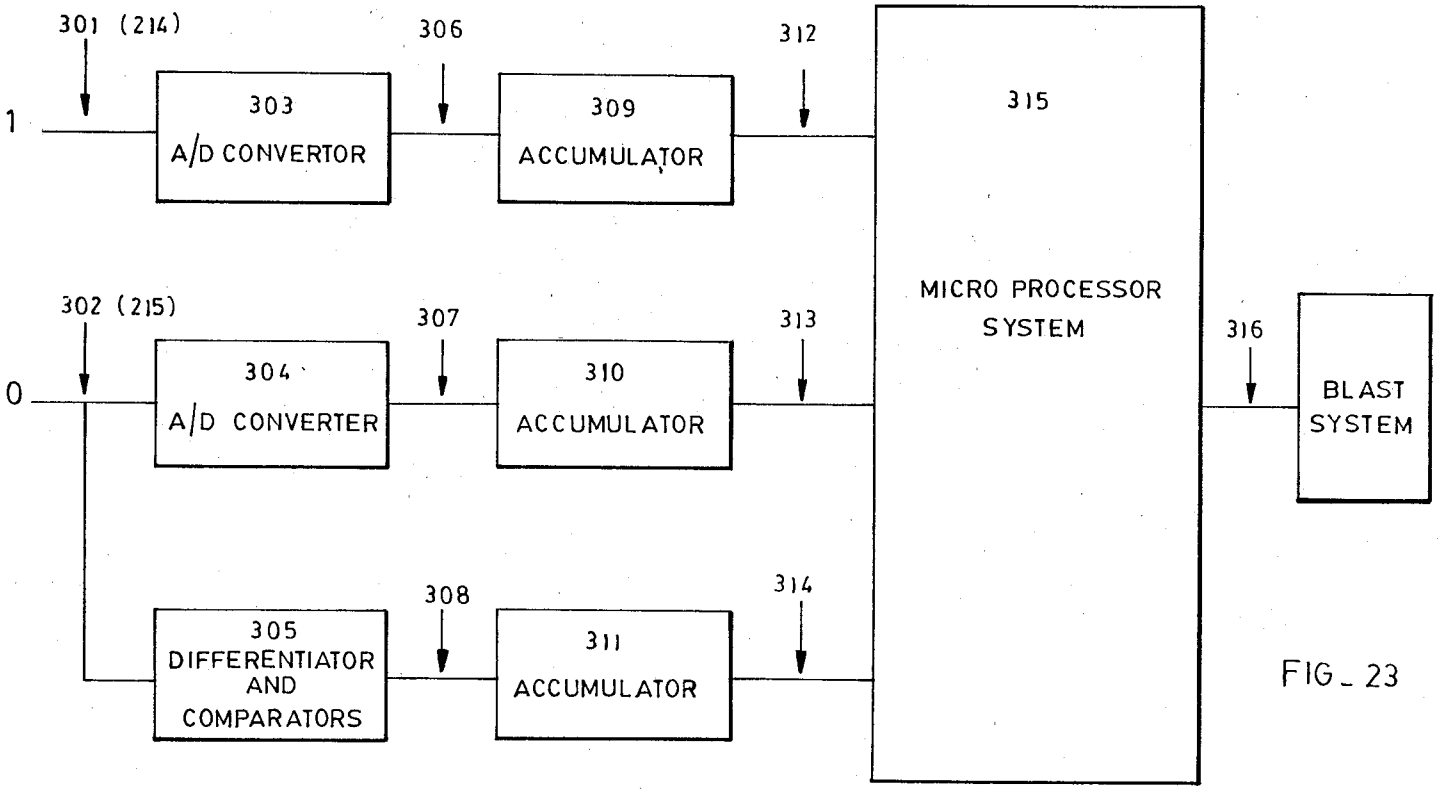
FIG. 23 shows schematically, a signal processing arrangement for the sorting the machine.

A processor 9 (FIG. 20) is programmed to distinguish between reef and waste particles by means of an algorithm which uses the "I" and "O" signals to identify reef particles and waste particles, shown in more detail in FIG. 23.

In FIG. 23 the "I" signal 301 and the "O" signal 302 are applied to digitizing circuits 303 and 304. These circuits convert the signals to digital form. Each time the laser beam has moved approximately 2 mm along the optical scan line, a digital number 306 and 307 is generated by the digitizing circuits 303 and 304 to represent the intensity of the "I" and "O" signals as the laser beam moves along that portion of the scan (from now on referred to as one pixel).

The digital numbers thus produced are applied to accumulating circuits 309 and 310. These circuits accumulate the digital numbers 306 and 307 in such a way as to produce accumulated numbers, so that at the end of each scan across the ore particle trajectory, the total number of pixels in each of 10 categories of intensity level, are applied to a microprocessor system 315 on data buses 312 and 313.

In addition, the "O" signal 302 is applied to differentiating and comparator circuit 305 which produces the derivative of the "O" signal and applies it to comparators.

The comparators produce signals 308 every time the rate of change of the "O" signal exceeds a preset magnitude and applies the signal to accumulator circuit 311. This circuit accumulates the number of times this occurs. Again, at the end of a scan across the ore path, the accumulated total number of times that the derivative of the "O" signal exceeded each of 10 preset levels is applied to the microprocessor system 315 over the data bus 314. These signals provide additional information for the identification of quartzite occuring in waste particles as opposed to quartzite pebbles in reef particles.

Microprocessor system 315 is programmed to analyse the signals applied to it according to an algorithm and to produce a decision based on these signals. According to the decision, blast signals 316 are sent to blast valves 317 to split the particle streams into two fractions (reef fraction and waste fraction).

The processing system consists of a common section 303, 304 and 305 in FIG. 23. The rest of the processing system is repeated once for every channel of the feed belt 104 (FIG. 20).

In a broad sense the invention resides in directing a narrow beam of electromagnetic radiation at objects to sort those objects which contain ore from those objects which do not. If the objects contain ore or as explained above, ore indicating particles, where the presence of gold is indicated by the presence of quartz pebbles in the described example, the ore bearing objects can be sorted from waste. While embodiments of the invention can be provided for sorting a large range of ores or ore bearing objects, there is an inherent limitation. Embodiments of the invention can only be applied where the ore and/or ore bearing or indicating objects are either opaque to or transmit the light at the wavelength used.

In the described example, gold ore is indicated in an object scanned by the laser beam because the presence of gold is indicated by the detection of quartz pebbles. As the laser beam scans over a quartz pebble, then because of the optical properties of the quartz, a significant part of the laser radiation, instead of being reflected directly by the surface of the object, enters into any quartz pebbles present to produce a "corona effect" or "halo". Thus, as the beam scans a quartz containing object, a halo occurs in the area around the area of incidence of the beam as it scans the surface of the object which is very marked and easy to distinguish from more direct surface reflections which occur at opaque regions of the surface of the object.

It will be noted that if the object is formed completely of quartz the "corona effect" occurs across the whole scan of the surface of the object by the laser beam. In that case there are no rapid changes in light intensity at the areas 18 or 20 so that a particle which is wholly made of quartz is rejected as required; that is when only the presence of pebbles indicate gold ore being present. If the object contained no quartz at all, there would be no "corona effect" during the whole scan provided the material is opaque to the radiation. This illustrates that embodiments of the invention can be provided to distinguish and therefore to sort quartz objects from objects containing no quartz or other opaque material. To be more accurate, the embodiments can distinguish objects which are wholly or in part opaque to the radiation from those objects which are not at all opaque.

The so called "corona effect" is easier to detect if the level of radiation incident on the surface of the object is high. Thus, a laser or like high energy source is preferred. It will be noted that transmittance can vary with the wavelength of radiation, a suitable wavelength is chosen according to what material is to be distinguished to provide the sorting of objects. In each case, the so-called "corona effect" which may not then be in the visible spectrum and is caused by the inherent optical properties of the material in question can be used to sort the objects.

Thus, embodiments of the invention can be provided to provide the sorting of a wide range of ore bearing objects, or objects of a particular material, from other objects. The wavelength of the radiation is chosen to match the physical properties of the objects so that the objects to be sorted are in part or in total opaque or transmitting as the case may be to the chosen radiation, with the provision, as explained earlier that sorting can only be effective if the other objects or parts thereof are respectively non-opaque or opaque respectively to that chosen radiation. Then by monitoring the reflection of the radiation from the surface of the objects, the non-opaqueness can be detected because instead of there being a generally simple reflection (as there is from an opaque area of the surface) there is generally a re-emittance of a light over a larger area which tends to produce a so called "corona effect". As stated above, the "corona effect" using laser radiation is very marked and can be readily detected using suitably positioned or arranged detectors which respond to light re-emitted as a result of internatal reflections and not direct surface reflections.

While this embodiment has been explained with express reference to the sorting of gold bearing reef, which is identified by determining the presence of quartz pebbles from waste material, other embodiments of the invention can have a much wider range of application, for example for sorting of bauxite ores, uranium ores, sedimentary iron ores (oolitic types) and various other ores of conglomerate, breccia, oolitic, pebbly or pisolitic types.

We claim:

1. A method of sorting objects of ore from other objects comprising the steps of directing a light beam across the objects in a predetermined scan pattern, detecting light reflected from the objects from the area of incidence of the beam and detecting the occurence of the re-emission of internal reflections from translucent inclusions in the objects of ore, from an adjacent area which is removed from the area of incidence of the beam by a predetermined amount, converting the detected surface and internal reflections into first and second signals respectively, generating a third signal corresponding to the rate of change of the second signal and analyzing the three signals in accordance with predetermined parameters to determine the characteristics of each object.

2. A method according to claim 1 comprising the steps of applying the first and second electrical signals to separate digitising circuits adapted to generate separate digital values corresponding to the intensity of the reflections detected from sequential portions on each scan line, applying the second signal to a differentiating and comparator circuit adapted to product a third signal value every time the rate of change of the second signal exceeds a predetermined magnitude, applying the first, second and third signal values to accumulating circuits and analyzing the accummulated signal values as a means of determining the characteristics of each object.

3. Apparatus for distinguishing between objects of ore and other objects comprising apparatus adapted to produce and direct a light beam across each object in a predetermined scan pattern, light detection apparatus adapted to detect light reflected from the objects from the area of incidence of the light beam and the occurence of the re-emission of internal reflections from translucent inclusions in the objects of ore, from an adjacent area removed from the area of incidence of the beam by a predetermined amount, means to convert the detected surface and internal reflections into first and second signals respectively, means to generate a third signal corresponding to the rate of change of the second signal and analysis means adapted to analyze the three signals in accordance with predetermined parameters to determine the characteristics of each object.

4. Apparatus according to claim 3 wherein the first and second electrical signals are applied to separate digitising circuits adapted to generate a digital value corresponding to the intensity of the surface and internal reflections respectively detected from sequential portions of each scan line, a differentiating and comparator circuit to which the second signal is applied to produce a third signal value when the rate of change of the second signal exceeds a predetermined magnitude, accumulating circuits to which the first, second and third signal values are applied and processor means adapted to determine the characteristics of each object in accordance with the first, second and third accumulated signal values for each object.

* * * * *